United States Patent [19]

Sugizaki

[11] 4,422,631

[45] Dec. 27, 1983

[54] PAPER FEEDING DEVICE FOR RECORDING APPARATUS

[75] Inventor: Tsugio Sugizaki, Hachioji, Japan

[73] Assignee: Konishiroku Photo Industry Co., Ltd., Tokyo, Japan

[21] Appl. No.: 265,362

[22] Filed: May 20, 1981

[30] Foreign Application Priority Data

May 28, 1980 [JP] Japan ..... 55-71012

[51] Int. Cl.[3] ..... B65H 5/26

[52] U.S. Cl. ..... 271/9; 271/127; 271/164

[58] Field of Search ..... 271/9, 127, 162, 164

[56] References Cited

U.S. PATENT DOCUMENTS 4,009,957 3/1977 Suzuki et al. ..... 271/9 X 4,227,800 10/1980 Nezu ..... 271/9 X

*Primary Examiner*—Robert B. Reeves

*Assistant Examiner*—David F. Hubbuch

*Attorney, Agent, or Firm*—Jordan B. Bierman; Linda Bierman; C. Cornell Remsen, Jr.

[57] ABSTRACT

A copier machine is provided with two or more paper feeder racks loaded with special recording paper cassettes, cooperating with a paper feeding device. The cassettes may contain paper of respectively different sizes. The paper feeding device is provided with a manual lever which not only selects the desired cassette to be fed but permits accurate and quick loading and unloading of one selected cassette while preventing the feeding of the nonselected cassette or cassettes. The manual lever is locked in its selected position but a sensor provides for unlocking the same and return of the manual lever to a neutral position when a paper feeding rack is completely loaded.

1 Claim, 6 Drawing Figures

PAPER FEEDING DEVICE FOR RECORDING APPARATUS

BACKGROUND OF THE INVENTION

1. Field of the Invention

The present invention relates to a paper feeding device for recording apparatus such as a copier machine, and particularly to a paper feeding device equipped with a plurality of paper feeder racks that can be individually loaded with special recording paper cassettes and selected for feeding recording papers.

2. Description of the Prior Art

In the general copier machine art, it has hitherto been a practice to provide special cassettes according to recording paper size so a cassette of proper size can be selected in conformity with the purpose of particular image reproduction for loading onto a paper feeder table. However, this design is very troublesome with a variable modification type electrophotographic copier machine that is endowed with a reduction or enlargement function. Namely, in such a variable magnification type copier machine, the image reproduction, for example, from documents of one of sizes of B series to recording papers of one of sizes of A series often gives more useful copies than other combinations, when it will be troublesome if it is necessary to exchange the cassette for a size of a different series every time the reduction or enlargement mode is started.

SUMMARY OF THE INVENTION

Accordingly, it is an object of the present invention to provide a paper feeding device that can be simultaneously fitted with a plurality of cassettes, each loaded with recording papers of a respective different size, and that allows accurate and quick loading and unloading of each cassette, by throwing a manual lever toward its corresponding loading/unloading position, namely, by an operation of a manual lever under the mechanical control of the operator.

DESCRIPTION OF THE PREFERRED EMBODIMENT

The above and other objects of the present invention will become more apparent from the following description of an embodiment with reference to the accompanying drawings.

Figure 1:
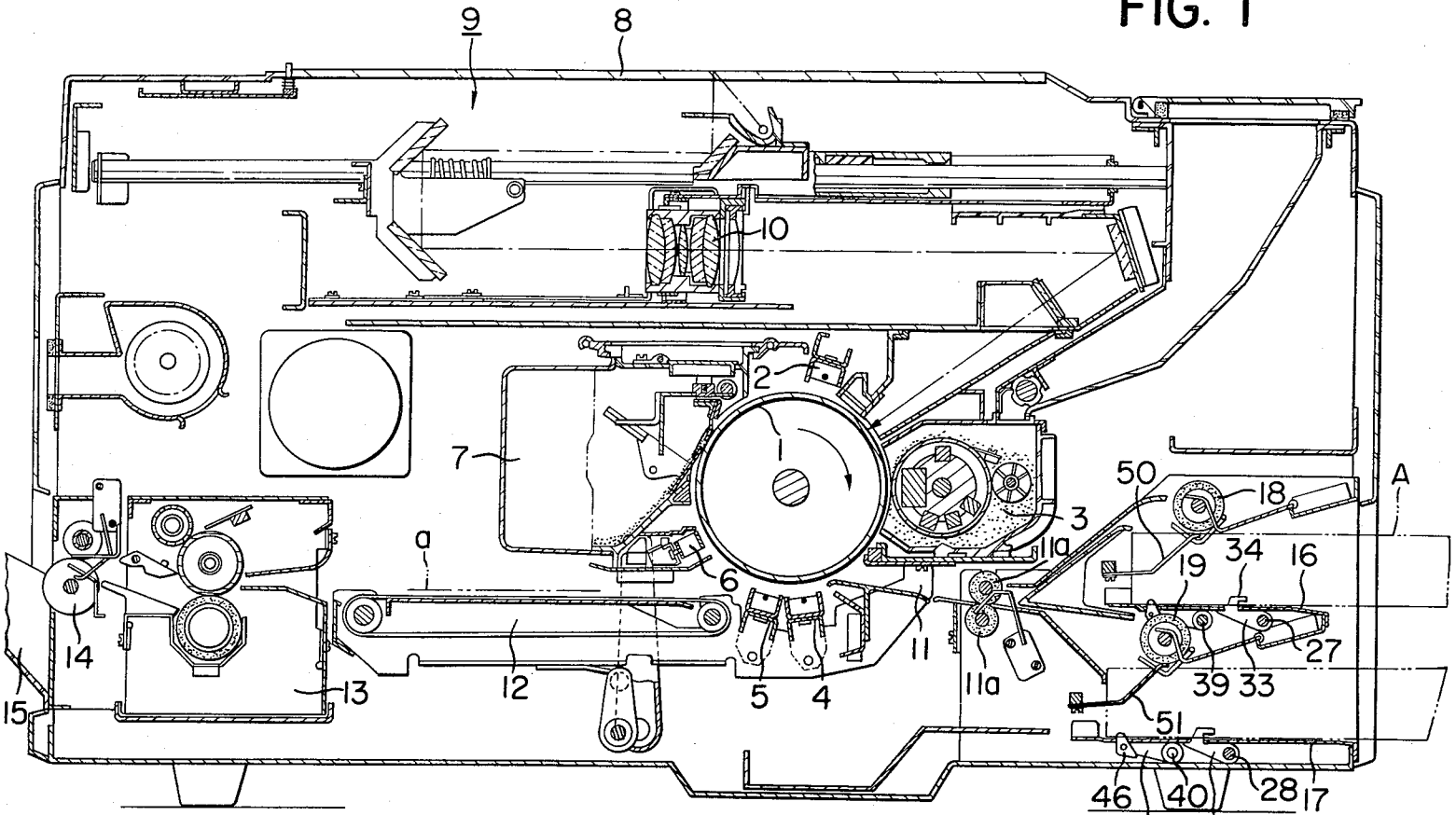
FIG. 1 is a vertical cross-sectional view of a variable magnification type electrophotographic copier machine equipped with a paper feeding device embodying the present invention.

FIG. 1 illustrates a generally known variable magnification type electrophotographic copier machine with the additional application of the present invention, a photoconductor drum 1 that can be driven in the direction of the arrow is surrounded by a charging unit 2, a developing unit 3, a transfer corona unit 4, a separator corona unit 5, a charge eliminating unit 6 and a cleaning unit 7 successively disposed in this order in the revolving sense of the drum 1. The image of a document placed on a document glass plate 8 is focused by an optical projection system 9 onto an area of the circumferential surface of the drum 1 located between the charging unit 2 and the developing unit 3. This optical projection system 9 is equipped with a projection lens 10 that is slidable in the direction of optical axis. Thus, switching over to a different magnification can be achieved by readjusting the position of this lens 10.

Further, the copier machine is equipped with a paper feeding device embodying the present invention that can be loaded with cassettes A and B of different types, each accommodating recording papers of a different size. The recording papers a that are fed piece by piece from this paper feeding device along a paper feeding path 11 are fed by rotation of a registration roller 11*a* onto the circumferential surface of the photoconductor drum 1. The toner image that has been developed on this surface by the developing unit 3 is thus transferred to the recording paper as this paper passes below the transfer corona unit 4. Thereafter, the recording paper with the toner image thereon is transported to a fixing unit 13 by a paper transporting unit 12 for heat-fixing the toner image, and is then ejected by a paper ejecting roller unit 14 to a copy receiving tray 15.

Figure 4:
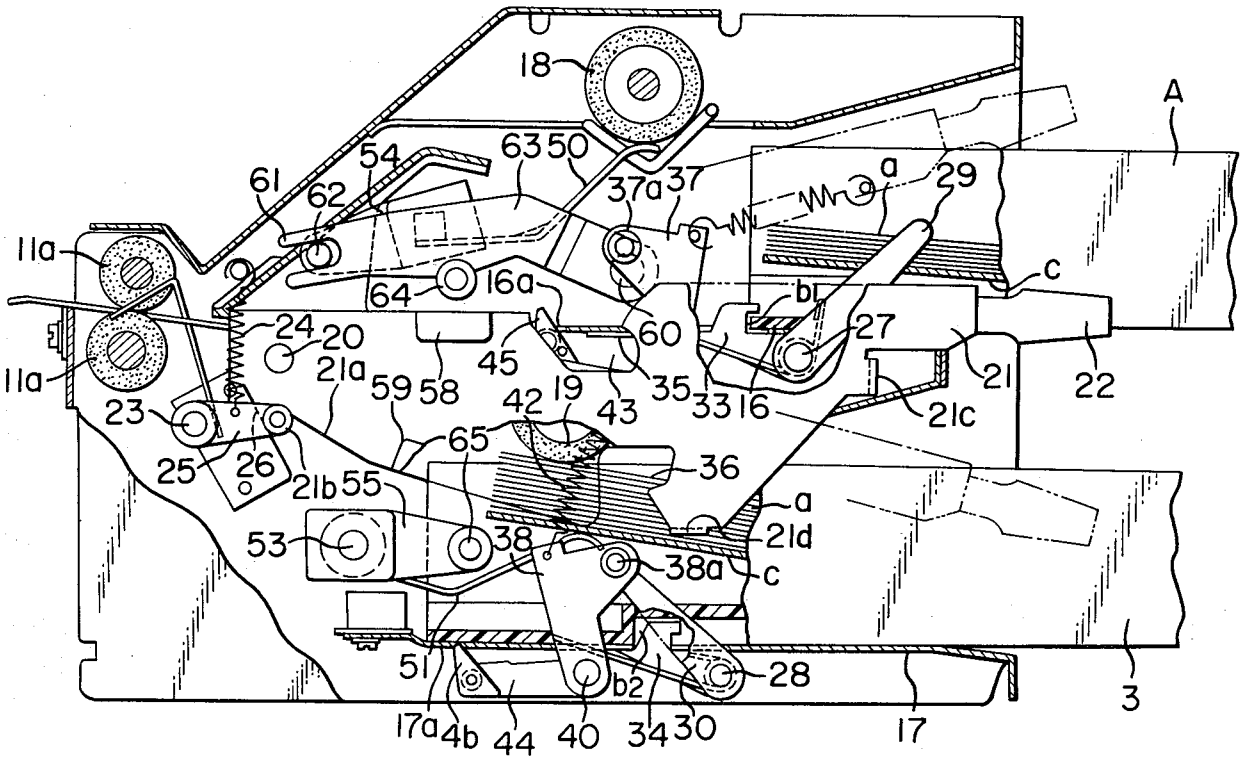
FIGS. 4 to 6 are enlarged cross-sectional views illustrating the different operating modes of the paper feeding device in FIG. 1.

The above paper feeding device of the present invention is equipped with a pair of paper feeder racks 16 and 17 that can be loaded with special cassettes A and B, respectively. On top of these racks 16 and 17, paper feeding rollers 18 and 19 are respectively disposed to feed recording papers a from the cassettes A and B that are mounted respectively on the said paper racks 16 and 17. On one side of these paper feeder racks 16 and 17, a manual lever 21 (FIG. 2) is provided, pivoted on a fulcrum pin 20 supported on the fixed frame of the machine. The manual lever 21 can be manually operated by an exposed control knob or handle 22 and has a cam face 21*a* (FIG. 4) at its base, which engages lever 25 pivoted on a shaft 23, and which is pulled by a tension spring 24. As a result, as a tip roller 26 on the pressure member 25 comes into a recess 21*b* (FIG. 5) made in the cam face 21*a* at the base for engagement, the manual lever 21 is held at the neutral position as illustrated in FIG. 4, while as the same tip roller 26 is engaging with a part of the cam face 21*a* other than the recess 21*b*, the lever 21 is pulled toward the neutral position under the action of the tension spring 24.

Figure 2:
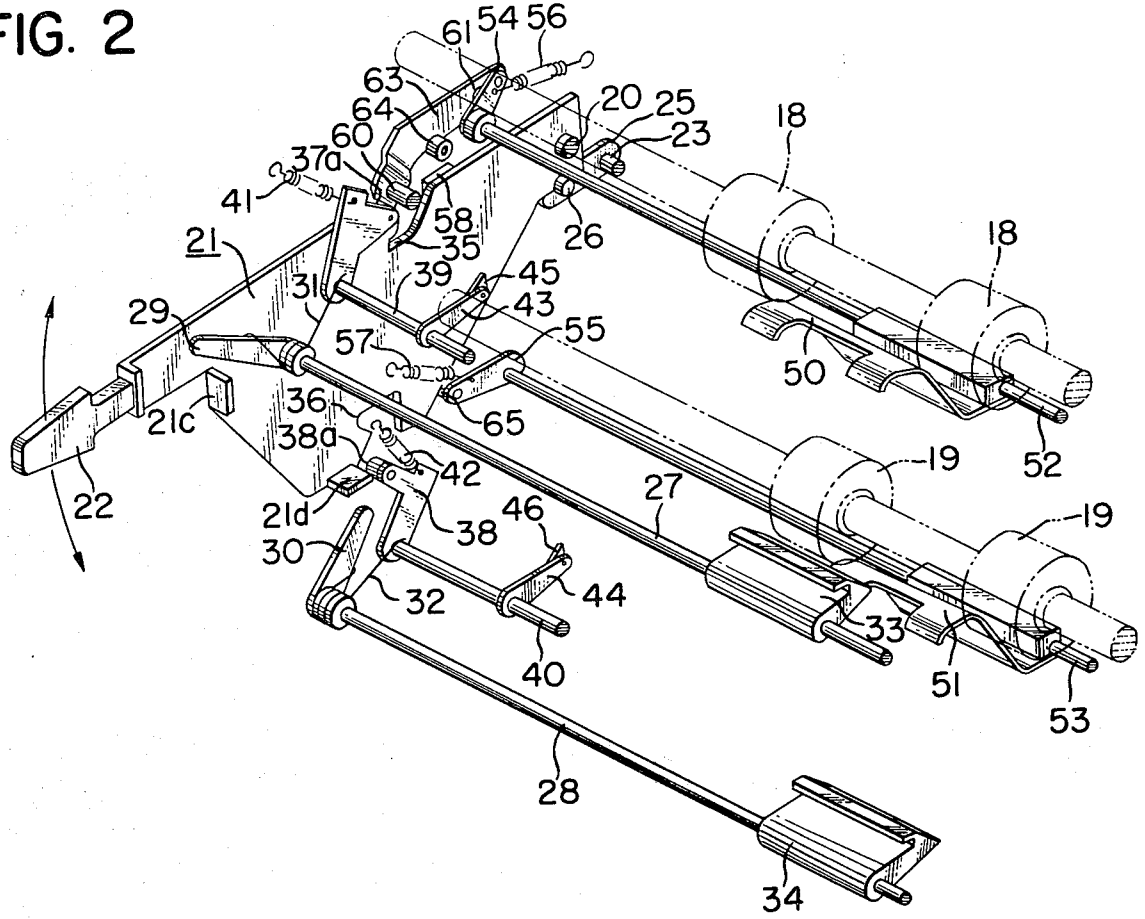
FIG. 2 is a perspective illustration of the major parts of the paper feeding device as shown in FIG. 1.

Referring to FIG. 2, the plate comprising the above lever 21 is bent perpendicularly at two points to provide actuator edges 21*c* and 21*d*, which respectively actuate follower levers 29 and 30 that are in turn secured to one end of stopper shafts 27 and 28 placed transversely below the paper feeder racks 16 and 17. These stopper shafts 27 and 28 are individually given torques under the action of springs 31 and 32, and stoppers 33 and 34 secured on the middle portion of the stopper shafts 27 and 28 may protrude from the top surface of their corresponding paper feeder racks 16 and 17 when the manual lever 21 is set at its neutral position. These stoppers 33 and 34, when they protrude from the top surface of racks 16 and 17, are capable of either stopping the entering edge b1 of the cassettes A and B to prevent their insertion or fitting into a recess b2 of these cassettes A and B to prevent their extraction.

Figure 3:
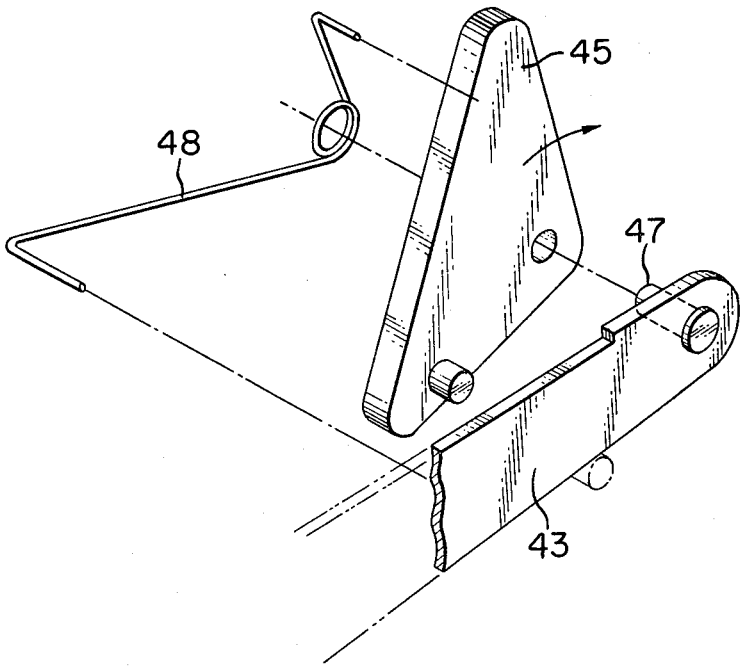
FIG. 3 is an enlarged exploded view of one of sensor levers and the sensor claw associated therewith.
Figure 5:
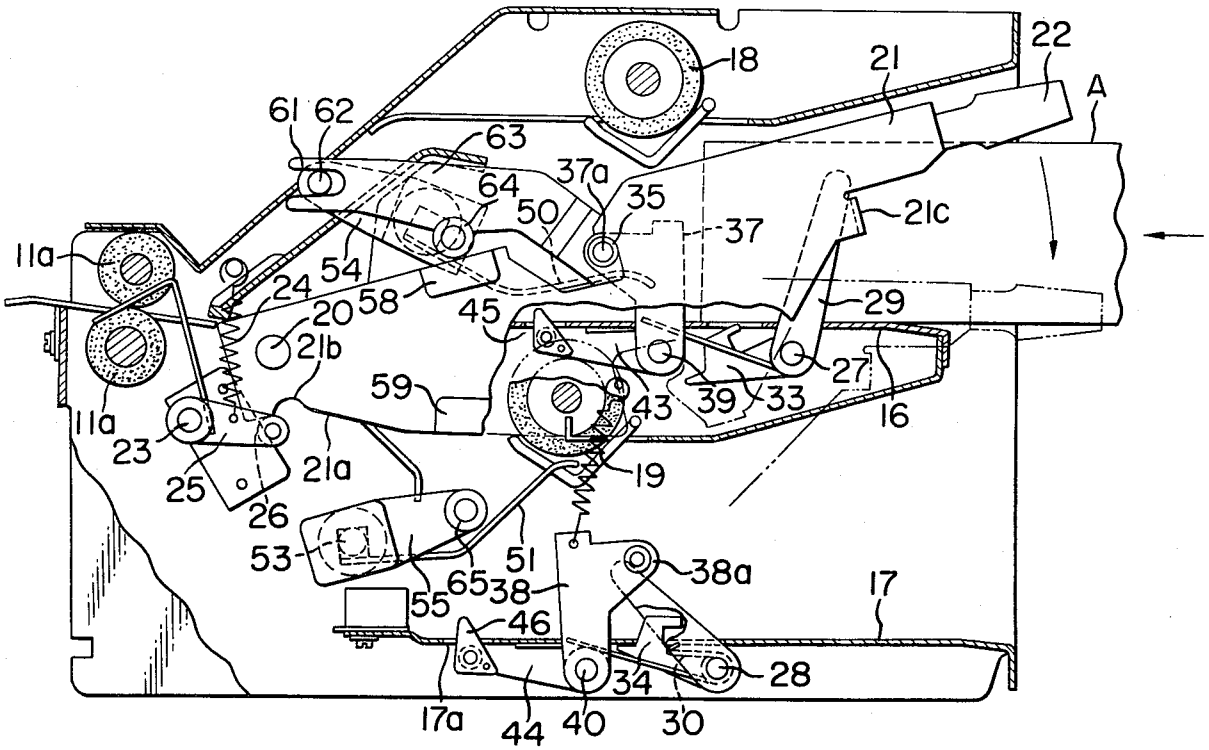
Figure 6:
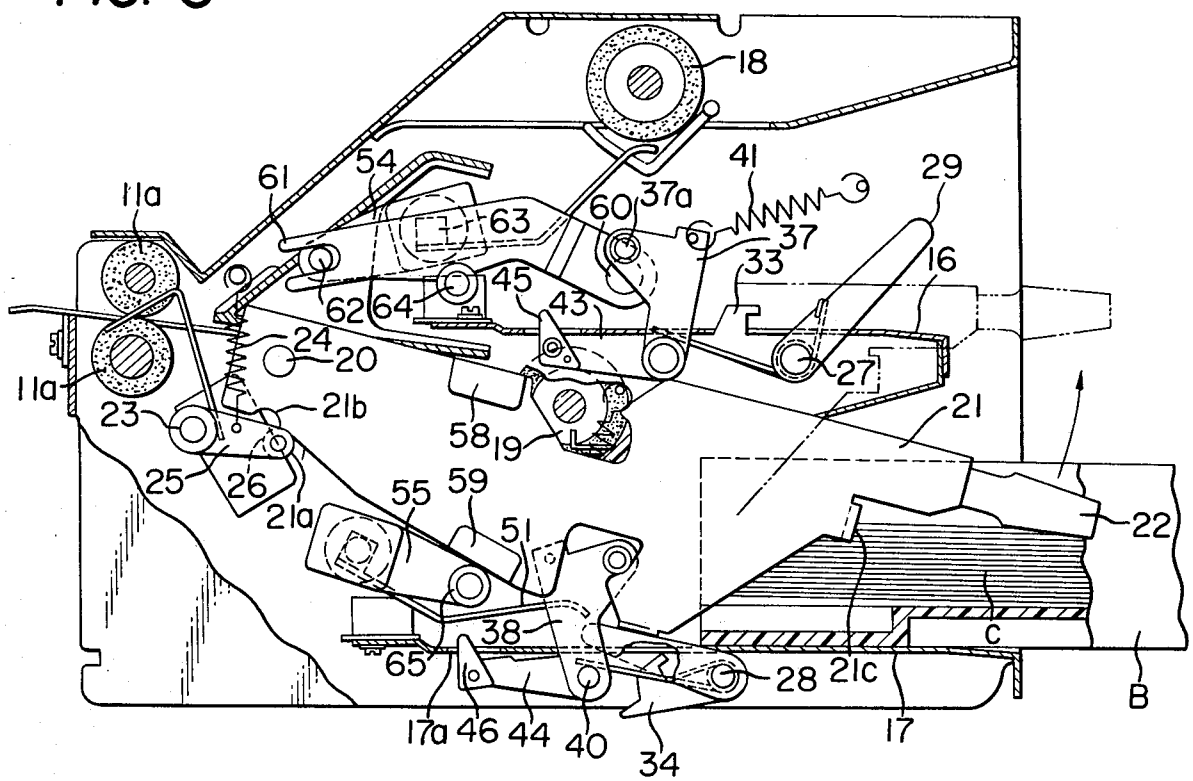

The manual lever 21 is provided with a pair of locking recesses 35 and 36 cut in its middle upper and lower parts, respectively. Facing these locking recesses 35 and 36, mating rollers 37*a* and 38*a* are provided on locking members 37 and 38. These locking members 37 and 38 whose bases are pivoted on shafts 39 and 40, respectively, supported by the fixed frame of the machine are given a torque in a predetermined sense under the action of tension springs 41 and 42, respectively. Therefore, as the lever 21 is set by a manual operation to the first position as illustrated in FIG. 5, the mating roller 37*a* fits into the locking recess 35 to lock the lever 21 to this first position and, as the lever 21 is set by a manual operation to the second position as illustrated in FIG. 6, the mating roller 38*a* fits into the locking recess 36 (FIG. 2) to lock the lever 21 to this second position. Further, sensor levers 43 and 44 are secured to the above shafts 39 and 40, respectively. The tips of these sensor levers 43 and 44 are fitted with sensor claws 45 and 46, respectively, that rise above the top surface of their corresponding paper feeder racks 16 and 17 through holes 16*a* and 17*a* made in these racks. The above sensor claws 45 and 46 are typically represented by, as illustrated in FIG. 3, a triangular form and pivoted on a pin 47 fitted to the tip of the sensor levers 43 and 44 with a spring 48 set between the levers 43 and 44 to give them a torque in the direction of the arrow. Further, the surface of these claws 45 and 46 is fitted with a check pin 49 that is engageable with the bottom face of the sensor levers 43 and 44.

The paper feeder racks 16 and 17 are also equipped with lifting members 50 and 51 that are capable of engaging with the bottom face of the cassette bottom plate c with recording papers a thereon to urge them toward the paper feeding rollers 18 and 19. These lifting members 50 and 51 are secured to the middle portion of shafts 52 and 53 supported by the fixed frame of the machine, and the lifting force is provided by the action of tension springs 56 and 57 that are hooked on levers 54 and 55 fitted toward an end of these shafts 52 and 53.

Portions of the manual lever 21 adjacent to the above levers 54 and 55 are fitted with actuator blocks 58 and 59. Namely, the actuator block 58 is so located that it faces a roller 64 on the middle portion of an intermediate lever 63 whose base is pivoted on a shaft 60 of the fixed frame of the machine with a recess 61 at the tip of the lever 63 fitted with a pin 62 on the lever 54. Therefore, as the manual lever 21 is set to the first position by a manual operation, the lever 54 is driven by the intermediate lever 63 against the action of the tension spring 56, so the lifting member 50 is lowered as illustrated in FIG. 5 to allow insertion of the cassette A for loading onto the paper feeder rack 16. Meanwhile, the actuator block 59 is so located that it faces a roller 65 on the tip of the lever 55. Therefore, as the manual lever 21 is set to the second position by a manual operation, the lever 55 is pushed down by the actuator block 59 against the action of the tension spring 57 to lower the lifting member 51 and allow insertion of the cassette B for loading onto the paper feeder rack 17.

Next, the paper feeding device of the present invention is described in its individual operating positions with reference to the FIGS. 4 to 6.

In FIG. 4, the manual lever 21 is set at its neutral position. In this case, the stoppers 33 and 34 protrude from the top surface of the paper feeder racks 16 and 17, so the cassette A cannot be inserted for loading onto the paper feeder racks 16, and the cassette B already loaded on the paper feeder racks 17 cannot be taken out.

In FIG. 5, the manual lever 21 is set by a manual operation to the first position, namely, a position that allows loading and unloading of the paper feeder rack 16. At this state, the locking recess 35 in the manual lever 21 engages with the mating roller 37*a* on the locking member 37 to lock this lever 21 to that position. At the same time, the follower lever 29 is driven about the stopper shaft 27 by the actuator edge 21*c* on the manual lever 21 to make the stopper 33 recede under the paper feeder rack 16, while the intermediate lever 63 is pivotally driven by the actuator block 58 on the manual lever 21 to lower the lifting member 50 to the position as illustrated in the same figure and thereby allow insertion of the cassette A. It is noted that at this state the stopper 34 protrudes from the top surface of the paper feeder rack 17, so this paper feeder rack cannot be loaded with the cassette B.

Next, as the cassette A is loaded onto the paper feeder rack 16, the entering edge b1 (see FIG. 4) of the cassette A pushes down the sensor claw 45 that rises above the paper feeder rack 16. Since the sensor lever 43 engages with the check pin 49 to prevent the above sensor claw 45 from rotation, the lever 43 itself is driven counterclockwise centering around the shaft 39 to disengage the mating roller 37*a* on the locking member 37 from the locking recess 35 in the manual lever 21, so the lever 21 returns back to the neutral position under the action of the tension spring 24. As a result, the stopper 33 fits into the recess b1 (see FIG. 4) in the cassette A for locking, making this cassette no more detachable, while the lifting member 50 springs up the cassette's bottom plate c under the action of the tension spring 56 to push recording papers a on this bottom plate to the paper feeding roller 18 and thereby make the paper feeding device ready to feed recording papers.

In FIG. 6, the manual lever 21 is set by a manual operation to the second position. In this case, engagement of the locking recess 36 and the mating roller 38*a* on the locking member 38 locks the lever 21 to the second position. As a result, the stopper 34 is driven by the actuator edge 21*d* to recede from above the paper feeder rack 17 while the lifting member 51 is pushed down by the actuator block 59. Naturally, as the cassette B is loaded onto the paper feeder rack 17, the sensor lever 44 senses loading of this cassette to unlock and return back the manual lever 21 to the neutral position as illustrated in FIG. 4.

It is noted that in order to unlock either cassette A or B loaded on the paper feeder racks 16 or 17 for its removal, it is just necessary to throw the manual lever 21 to either the first or the second position and then slightly draw out that cassette while the lever is being kept there for a moment.

It is evident from the above description that according to the present invention, if, for example, a pair of cassettes, each carrying recording papers of a different size are loaded, selection can be made from two recording paper sizes, as necessary, for use. Further, according to the present invention, since no cassette can be loaded or unloaded unless the manual lever is set by a manual operation to the corresponding cassette insertion/-detachment position, the paper feeding device is protected from any failure that may otherwise be caused by a careless operation and in addition when a cassette is properly loaded, it is automatically locked to the paper feeder rack, so the cassette handling becomes simpler and easier. Moreover, the paper feeding device of the present invention has the merit that it can be operated according to the natural mechanical sense of operator, for a manual operation of the manual lever toward the paper feeder rack to load or unload a cassette thereon or therefrom is enough to accomplish the intended task. Though in the above embodiment a double cassette type paper feeding system was used, it is a matter of course that the present invention can also be applied to any multiple cassette paper feeding system that uses three or more cassettes.

What is claimed is:

1. A paper feeding device for recording apparatus comprising, a plurality of paper feeding racks for loading detachable cassettes loaded with paper, a paper feed roller for each rack a manual lever capable of taking a plurality of positions, each corresponding to one of said paper feeding racks and a neutral position, means urging the return of said lever from each of said plurality of positions back to said neutral position, a stopper for each rack prohibiting the loading of a cassette onto a corresponding paper feeding rack and removal of any already loaded cassette from said paper feeding rack whenever said manual lever is set to a position corresponding to said rack, a locking member for locking said manual lever when said manual lever is moved to one of said positions, a sensor for unlocking said locking member and for permitting return of said manual lever to said neutral position whenever a paper feeding rack is completely loaded with a cassette, and further means for permitting insertion of a cassette when said manual lever is set to one of said positions, and for urging the paper into contact with said paper feeder roller when said manual lever is returned back to its neutral position.

* * * * *